United States Patent [19]

Beneteau

[11] 4,099,436

[45] Jul. 11, 1978

[54] APPARATUS FOR PIERCING SHEET MATERIAL

[76] Inventor: Donald Joseph Beneteau, 1333 Front Rd. South, Amherstburg, Ontario, Canada

[21] Appl. No.: 786,299

[22] Filed: Apr. 11, 1977

[51] Int. Cl.[2] ..... B26D 5/12

[52] U.S. Cl. ..... 83/617; 83/639; 60/560

[58] Field of Search ..... 83/617, 639; 219/89; 60/560

[56] References Cited

U.S. PATENT DOCUMENTS

| | | | |
|---|---|---|---|
| 3,119,292 | 1/1964 | Schmid | 83/639 |
| 3,238,832 | 3/1966 | Williamson | 83/639 |
| 3,827,328 | 8/1974 | La Flamme et al. | 83/617 |
| 3,875,365 | 4/1975 | Beneteau | 60/560 X |
| 4,026,192 | 5/1977 | Noren et al. | 83/617 X |

*Primary Examiner*—Donald R. Schran
*Attorney, Agent, or Firm*—Allen D. Gutchess, Jr.

[57] ABSTRACT

Apparatus and controls therefor are provided for piercing sheet material. A punch is driven by a cylinder and piston positioned in tandem with a second cylinder and piston. The arrangement is such that a small pressure applied to the second piston results in a large force applied by the punch to the sheet material. Controls for the apparatus include means to sense a sudden drop in pressure in the second cylinder and means to then supply return air to the rod ends of the cylinders. The controls are quickly responsive so that as the punch breaks through the sheet material, it is immediately reversed toward its original position. The noise and jarring ordinarily resulting when a punch breaks through sheet material being pierced are thereby substantially eliminated.

11 Claims, 5 Drawing Figures

APPARATUS FOR PIERCING SHEET MATERIAL

This invention relates to piercing apparatus and to controls therefor.

The apparatus according to the invention includes tandem hydraulic and pneumatic cylinders and pistons to drive a punch. These tandem cylinders are basically disclosed in my U.S. Pat. No. 3,875,365. The controls include sensing means for sensing a pressure drop in the pneumatic cylinder and means responsive to the sensing means which supplies return air to both cylinders upon a sudden pressure drop. Ordinarily when a punch breaks through a thick sheet of metal being pierced, a loud clunk is heard along with considerable shock or vibration. The new controls, however, are so quickly resonsive that the pistons are reversed before the noise and vibration can occur. This is made possible, at least in part, by the relatively small volume of air required for the tandem cylinders.

It is, therefore, a principal object of the invention to provide improved piercing apparatus and controls.

Another object of the invention is to provide an improved drive arrangement for powering a punch.

Yet another object of the invention is to provide apparatus and controls for piercing sheet material which eliminate the usual noise and vibration ordinarily occuring when the punch breaks through the sheet material.

Many other objects and advantages of the invention will be apparent from the following detailed description of a preferred embodiment thereof, reference being made to the accompanying drawings, in which.

Figure 2:
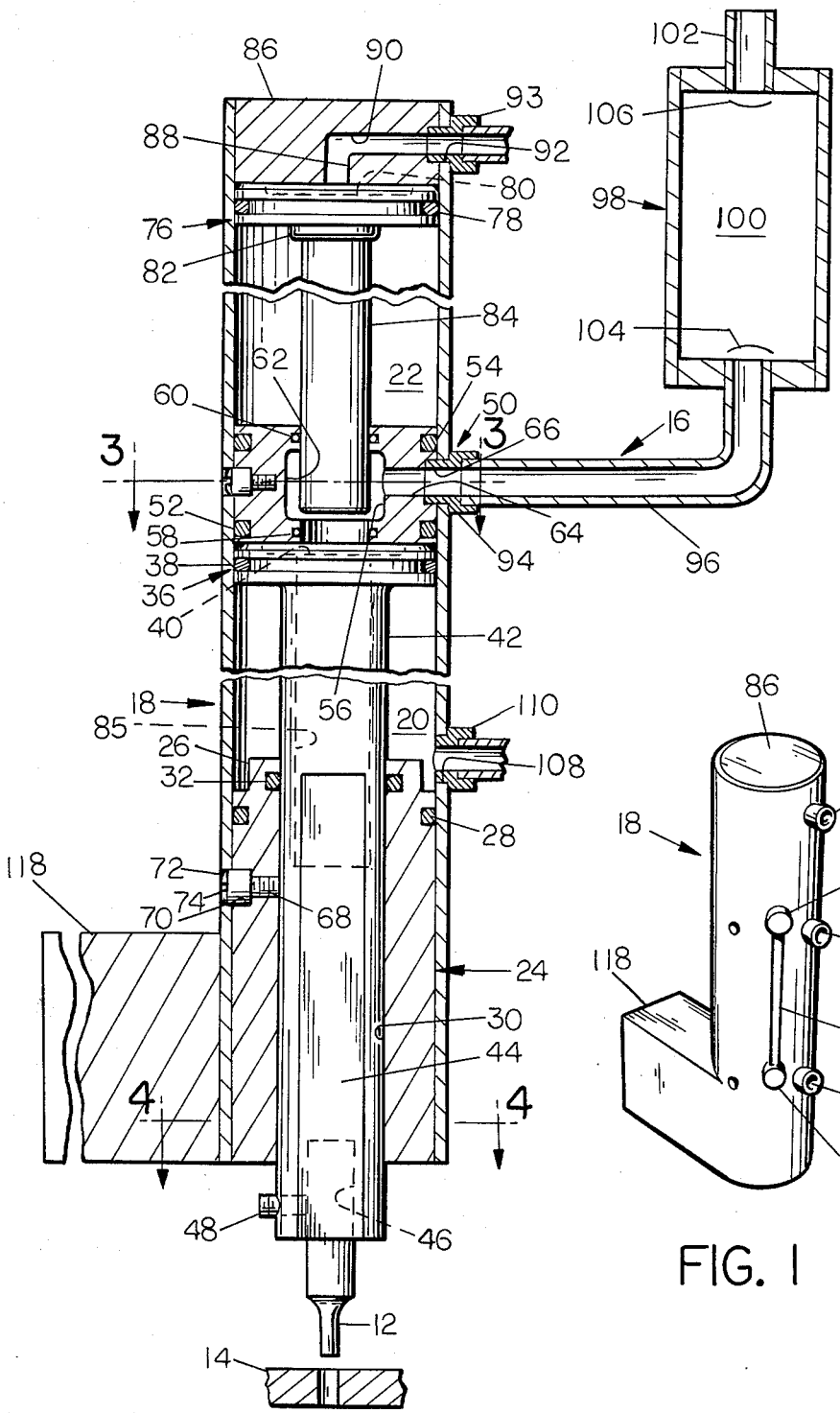
FIG. 2 is an enlarged view in vertical cross section taken through the apparatus of FIG. 1.
Figure 1:
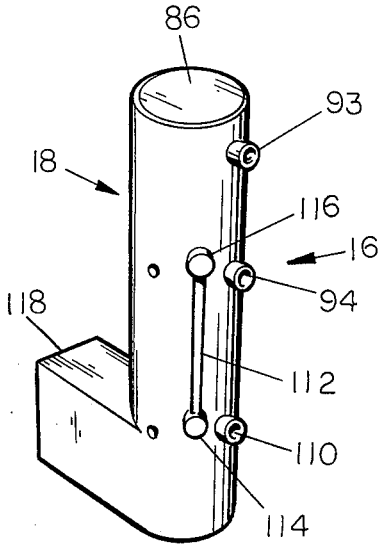
FIG. 1 is a view in perspective of apparatus embodying the invention.

Referring to FIGS. 1 and 2, apparatus for piercing holes in sheet material, and particularly metal, is indicated at 10. The apparatus includes a punch 12, a die 14, a drive unit 16 and the controls of FIG. 5. The punch and the die are basically of a known design.

Figure 4:
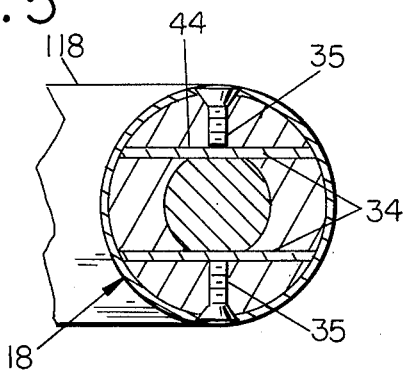
FIG. 4 is a view in transverse cross section taken along the line 4—4 of FIG. 2.

The drive unit 16 has a cylindrical housing 18 which forms a first cylindrical chamber 20 and a second cylindrical chamber 22. The lower end of the first cylindrical chamber 20 is defined by a plug or block 24 which has a smaller diameter neck 26 and an intermediate outer seal 28 engaging the inner surface of the housing 18. The block 24 also has a central cylindrical bore 30 extending therethrough with a seal 32 near the upper end thereof in the neck 26. Referring also to FIG. 4, the lower end of the bore 30 has two bars 34 affixed in grooves in the end of the block 24 by screws 35.

A piston 36 is located within the first chamber 20 and has an annular seal 38 and an upper, shallow recess 40. A piston rod 42 is connected to the piston 36 and extends out of the chamber 20 through the bore 30. The piston rod 40 has two flats 44 along a lower portion thereof which cooperate with the bars 34 to prevent rotation of the piston rod and also to guide it. The upper, cylindrical portion of the piston rod 42 cooperates with the seal 32 at all times, for any position of the piston 34, to provide a seal at the lower end of the chamber 20. The lower end of the piston rod has a central recess 46 in which the punch 12 is held by a setscrew 48.

An intermediate plug or block 50 separates the chambers 20 and 22, defining the upper end of the lower chamber 20 and the lower end of the upper chamber 22. The block 50 has outer lower and upper seals 52 and 54 which engage the inner surface of the housing 18. The block also has a central cylindrical bore 56 with inner lower and upper seals 58 and 60. At an intermediate portion of the bore 56 is an annular chamber 62 communicating with a supply passage 64 which is aligned with a port 66 in the housing 18.

Figure 3:
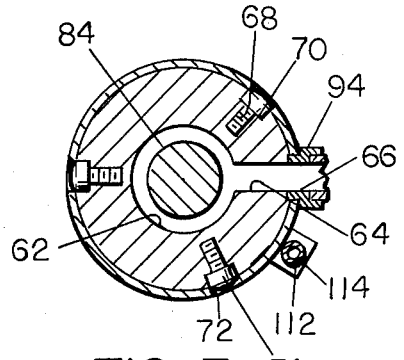
FIG. 3 is a view in transverse cross section taken along the line 3—3 of FIG. 2.

The blocks 24 and 50 are secured in the housing 18 by the same means, as shown in FIG. 3. Each of the blocks has three tapped recesses 68 communicating with outer, larger diameter recesses 70 at the surfaces thereof. The latter recesses are aligned with openings 72 in the cylindrical housing 18 and Allen head screws 74 are threaded into the tapped recesses 68. The heads of the screws are partly received in the recesses 70 and partly received in the holes 72 of the housing 18, the heads having a tight fit in the holes 72 to securely position the blocks in the housing. This mounting arrangement for the blocks also minimizes the possibility of distorting the housing 18 when the blocks are fastened in place.

A second piston 76 is located in the upper chamber 22 and has an annular seal 78 therearound, an upper shallow recess 80, and a lower, downwardly-extending shoulder portion 82. A cylindrical piston rod 84 extends downwardly from the piston 76 into or through the bore 56 and is at all times in contact with the inner, upper seal 60 to provide a seal at the lower end of the chamber 22. In a lower position, the piston rod 84 is also in contact with the lower inner seal 58 to seal off the annular chamber 62 and the upper end of the lower chamber 20. The lower piston 36 has a deep central recess or cavity 85 in the upper end into which the piston rod 84 can extend, although ordinarily, the lower end of the piston rod 84 will not reach the piston 36.

An upper plug or block 86 is silver soldered in the upper end of the housing 18 and defines the upper end of the chamber 22. The block 86 has a central recess 88 which communicates with a threaded transverse bore 90, a port 92 in the housing 18, and a fitting or nipple 93.

Hydraulic liquid, such as oil, under pressure is supplied to the annular chamber 62 and to the upper end of the chamber 20. For this purpose, a nipple 94 is aligned with the port 66 and is affixed to the housing 18. A tube 96 is connected to the nipple 94 and communicates with a cylindrical housing 98 forming a gas-liquid, specifically air-oil, chamber 100. The upper end of the housing has a supply line 102 through which gas, specifically air, is supplied to the chamber 100 with the tube 96 and the line 102 having baffles 104 and 106 which prevent oil entering the air line and air entering the oil line.

To return the pistons 36 and 76 to their upper positions, as shown, from lower positions, the chamber 20 has a lower return air port 108 which communicates with the lower annular portion of the chamber 20 around the block neck 26. A nipple 110 is aligned with the port 108 and is affixed to the cylindrical housing 18. Return air for the upper chamber 22 is supplied from the lower chamber 20. For this purpose, as shown in FIG. 1, the housing 18 has a tube 112 extending from a fitting 114 communicating with the lower end of the lower chamber 20 to a fitting 116 communicating with a lower end of the upper chamber 22.

The unit must be held rigidly by the piercing machine in order to obtain the desired accuracy. Accordingly, a solid, thick, rigid, mounting bar 118 is affixed to a lower portion of the housing 18 and extends outwardly perpendicular thereto. The mounting bar extends from the bottom edge of the housing up near the mounting holes 66 in the housing for the Allen head screws 74. This dimension can be increased for additional rigidity if desired. However, the mounting bar 118 has a horizontal width not exceeding the diameter of the housing 18, as shown particularly in FIG. 1. This enables the units 16 to be placed in side-by-side relationship with the outer surfaces of the housings 18 tangential, if desired. Thus, maximum versatility in the placement of the drive units 16 is achieved with this design.

In the operation of the drive unit 16, the pistons 34 and 76 initially are at the upper ends of the chamber 20 and 22. Air is then supplied through the line 102 to the chamber 100 causing oil therein to move under pressure through the tube 96, the port 66, the passage 64, and the annular chamber 62. From here it flows through the lower portion of the bore 56 into the upper end of the chamber 20 on the side of the piston 34 opposite the piston rod 42. This oil forces the piston 34 downwardly until the punch 12 comes into contact with the upper surface of the sheet material to be pierced. When the pressure in the upper portion of the chamber 20 reaches a given value, gas, specifically air, under pressure is supplied through the fitting 93, the port 92, the threaded bore 90, and the central recess 88 into the upper chamber 22. This air forces the piston 76 downwardly, and when the piston rod 84 contacts the lower seal 58, oil flow is prevented and the oil in the upper portion of the chamber 20 is trapped. As the piston rod 84 moves into the chamber 20, the trapped oil forces the piston 36 downwardly under high pressure and at a slower rate than the movement of the piston rod 84 and the piston 76. The force applied by the punch 12 to the workpiece is accordingly also multiplied so that, by way of illustration, with oil at a pressure of 100 psi, the force of the punch 12 on the workpiece can be 4200 pounds with the housing 18 having a 2½ inch inner diameter.

When the piercing is completed, the return fluid, specifically air, is supplied to the lower ends of the chambers 20 and 22 to move the pistons 36 and 76 back to the upper portions of the chambers, as shown. At this time, the oil is forced back through the tube 96 of the cylinder 98, with air in the chamber 100 being vented.

Ordinarily when stamping and piercing operations occur, there is a substantial clunking noise as the punch breaks through the metal. At the same time, a substantial shock or vibration occurs in the machine. The noise can be distracting and even harmful to workers. Also, particularly if the piercing operation is near other machines, the shock can harm the accuracy or precision of the other machines. This is particularly true where a number of operations are performed on workpieces located on a common turntable, by way of example.

Figure 5:
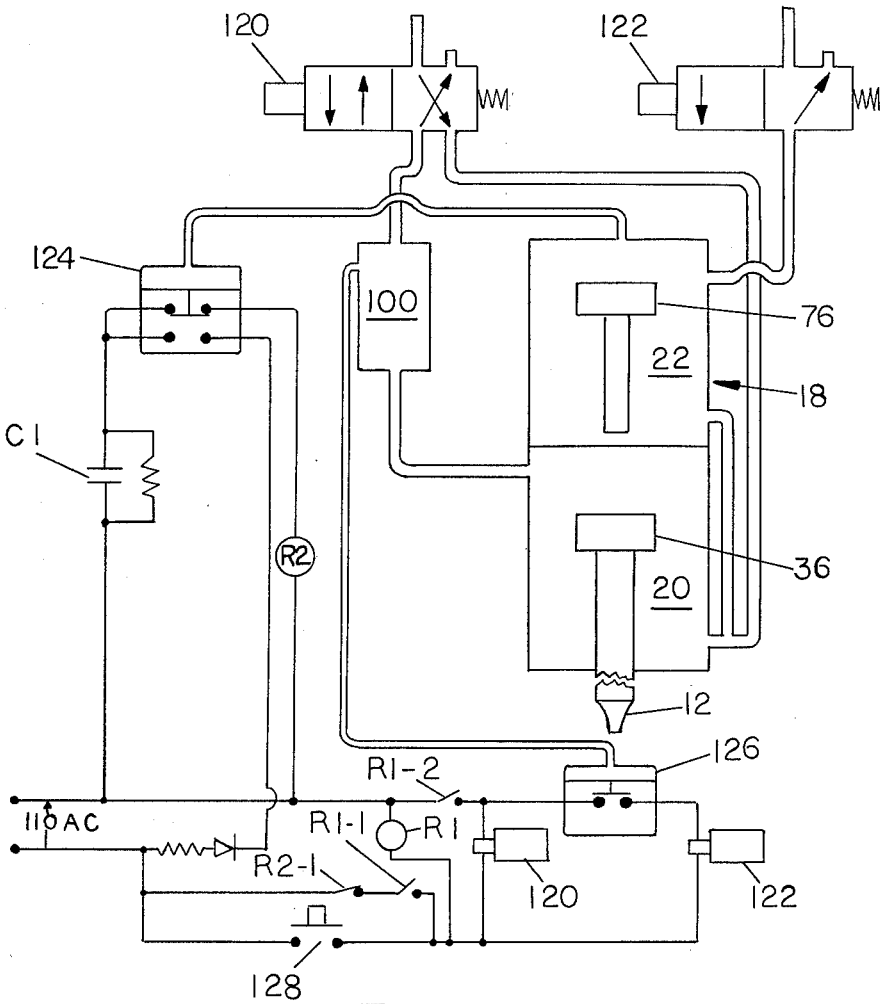
FIG. 5 is a diagrammatic view of controls used with the apparatus.

With the controls of FIG. 5 and with the relatively small amounts of air required for the drive unit 16, the return air can be supplied to the chambers 20 and 22 about the time of breakthrough of the punch in the sheet material so that the noise and vibration from the breakthrough can be substantially reduced or eliminated.

A four-way valve 120 controls the supply of air to and from the air-oil chamber 100 and the lower ends of the chambers 20 and 22. When in its unactuated position, as shown, the valve 120 supplies the return air to the chambers 20 and 22 and vents the air from the air-oil chamber 100 so that the pistons 36 and 76 are in their upper positions, as shown in FIG. 2. When the valve 120 is actuated, it then supplies air to the chamber 100 and vents return air from the lower chambers 20 and 22.

The air supply for the upper end of the chamber 22 is controlled by a three-way valve 122. When the valve 122 is in the unactuated position, as shown, air in the upper end of the chamber 22 is vented. When the valve 122 is actuated, air is supplied to the upper end of the chamber 22. Other components of the controls of FIG. 5 are also shown in their unactuated or inactive positions.

A pressure switch 124 senses the air pressure in the upper end of the chamber 22 or in the supply line therefor. A second pressure switch 126 senses the air pressure in the air-oil chamber 100 or in its air supply line.

In operation, when a start switch 128 is momentarily depressed, it actuates a relay R1 which then holds itself in through contacts R1-1 and closes its second contacts R1-2 which then energize the four-way valve 120. When the valve 120 is energized, it supplies air to the air-oil chamber 100 and vents return air from the lower ends of the chambers 20 and 22. During this time, there is no pressure in the upper end of the chamber 22 with the upper contacts of the pressure switch 124 being closed. However, a DC relay R2 will not be energized at this time by the AC power source.

As the air pressure in the chamber 100 builds, the contacts of the pressure switch 126 close to energize the valve 122 and cause air to be supplied to the upper end of the chamber 22. This causes the lower contacts of the pressure switch 124 to close, enabling a capacitor C1 to charge. The air pressure forces the piston 76 downwardly to multiply the pressure on the piston 36 and the force of the punch 12 on the sheet material.

When the pressure in the upper end of the chamber 22 drops suddenly, indicating that the punch 12 is breaking through the sheet material, the contacts of the pressure switch 124 move back to the upper position. At this time the capacitor C1 discharges through the DC relay R2 which is energized for a short period. Its contacts R2-1 bypassing the start switch 128 then open and cause the valves 120 and 122 to drop out and move back to their unactuated positions, as well as to drop out the relay R1 to prevent initiation of another cycle unless the start button 128 is pushed.

The air in the upper portion of the chamber 22 and the air in the chamber 100 are then vented and the return air is supplied to the lower ends of the chambers 20 and 22 to move the pistons 36 and 76 upwardly. These controls act quickly enough, which is also enabled by the small amounts of air employed, so that the normal noise and shock of the breakthrough are eliminated or substantially so.

Various modifications of the above-described preferred embodiment of the invention will be apparent to those skilled in the art, and it is to be understood that such modifications can be made without departing from the scope of the invention, it they are within the spirit and the tenor of the accompanying claims.

I claim:

1. Apparatus for piercing sheet material comprising means forming a first chamber, a first piston in said first chamber, a first piston rod connected to said first piston and extending out of said chamber, a punch affixed to an end of said piston rod, means forming a second chamber, a second piston in said second chamber, a second piston rod connected to said second piston and extendable into said first chamber, first passage means for directing liquid to said first chamber on the side of said first piston opposite said first piston rod, second passage means for directing gas to said second chamber on the side of said second piston opposite said second piston rod, third passage means for directing fluid to both of said chambers on the sides of said first and said second pistons having said first and said second piston rods, means for sensing the pressure of gas in said second chamber on the side of said second piston opposite said second piston rod, and means responsive to said sensing means for supplying fluid through said third passage means to said chambers and for exhausting gas from said second chamber on the side of said second piston opposite said second piston rod upon a sudden drop in the pressure of the gas sensed by said pressure-sensing means.

2. Apparatus according to claim 1 characterized by said last-named means exhausts the gas from said second chamber through said second passage means.

3. Apparatus according to claim 1 characterized by pressure means communicating with said first passage means for placing the liquid under pressure.

4. Apparatus according to claim 3 characterized by valve means for simultaneously supplying gas under pressure to said liquid pressure means and for venting fluid from said third passage means and also for simultaneously venting gas under pressure from said liquid-pressure means and for supplying fluid under pressure to said third passage means.

5. Apparatus according to claim 4 characterized by second pressure-sensing means for sensing the pressure of gas in said liquid pressure means, and additional responsive means responsive to said second pressure-sensing means for supplying gas to said second passage means.

6. Apparatus according to claim 1 characterized by said first piston and said first piston rod having a deep, central recess extending downwardly from an upper face of said first piston and of a size to receive said second piston rod.

7. Apparatus for manipulating a tool comprising means forming a first chamber, a first piston in said first chamber, a first piston rod connected to said first piston and extending out of said chamber, a tool affixed to an end of said piston rod, means forming a second chamber, a second piston in said second chamber, a second piston rod connected to said second piston and extendable into said first chamber, means for supplying fluid under pressure to said second chamber on the side of said second piston opposite said second piston rod, means for sensing the pressure of fluid in said second chamber on the side of said second piston opposite said second piston rod, and means responsive to said sensing means for supplying fluid to both of said chambers on the sides of said first and said second pistons having said first and said second piston rods upon a drop in the pressure of the fluid sensed by said pressure-sensing means.

8. Apparatus according to claim 7 characterized by said sensing means comprising a pressure switch and said responsive means comprising an electrically-operated valve.

9. Apparatus according to claim 7 characterized by means for supplying liquid under pressure to said first chamber on the side of said first piston opposite said first piston rod, second sensing means sensing the pressure of the liquid, and second means responsive to said second sensing means for controlling the supply of fluid under pressure to said second chamber on the side of said second piston opposite said second piston rod.

10. Apparatus according to claim 9 characterized by said second sensing means comprising a pressure switch and said second responsive means comprising an electrically-operated valve.

11. Apparatus according to claim 7 characterized by said first piston and said first piston rod having a deep, central recess extending downwardly from an upper face of said first piston and of a size to receive said second piston rod.

* * * * *